United States Patent [19]

Riefler

[11] 4,001,988

[45] Jan. 11, 1977

[54] CONCRETE BLOCK PANEL

[76] Inventor: Monte Riefler, P.O. Box 210, Hamburg, N.Y. 14075

[22] Filed: Jan. 9, 1975

[21] Appl. No.: 539,774

[52] U.S. Cl. ..... 52/125; 52/745

[51] Int. Cl.[2] ..... E04G 21/00

[58] Field of Search ..... 52/125, 122, 227, 745

[56] References Cited

UNITED STATES PATENTS

| | | | |
|---|---|---|---|
| 1,529,317 | 3/1925 | Ludeman | 52/125 |
| 2,781,657 | 2/1957 | Taylor | 52/227 |
| 3,304,673 | 2/1967 | Ramoneda | 52/314 |
| 3,478,482 | 11/1969 | Weir | 52/122 |
| 3,559,361 | 2/1971 | Sarros | 52/227 |

FOREIGN PATENTS OR APPLICATIONS

| | | | |
|---|---|---|---|
| 217,818 | 12/1956 | Australia | 52/125 |
| 1,062,502 | 12/1953 | France | 52/227 |
| 807,136 | 6/1957 | Germany | 52/125 |

*Primary Examiner*—J. Karl Bell
*Attorney, Agent, or Firm*—Ralph Hammar

[57] ABSTRACT

A concrete block wall panel with mortarless joints in which the blocks are held together by steel strapping and are reinforced by external coatings of glass fiber cement. The walls are handled by pick up rods extending through the panel from top to bottom. A swivel fitting is attached to the upper end of each rod and a pick up base engaging the bottom of the panel is screwed on the lower end of each rod. After the panel is set in a bed of mortar embedding the bases, the pick rods are unscrewed and the swivels are removed.

13 Claims, 9 Drawing Figures

CONCRETE BLOCK PANEL

This invention is a modular concrete block panel wall which is prefabricated by the block manufacturer and delivered to the construction site in modular sizes such as, for example, 8 feet high × 12 feet in length. In steel frame buildings the ends of the panels may be received in vertical steel channels and are dropped in place by the same crane which erects the steel so that at the end of the steel erection the entire building wall is completed with a negligible addition to the total steel erection time.

Figure 5:
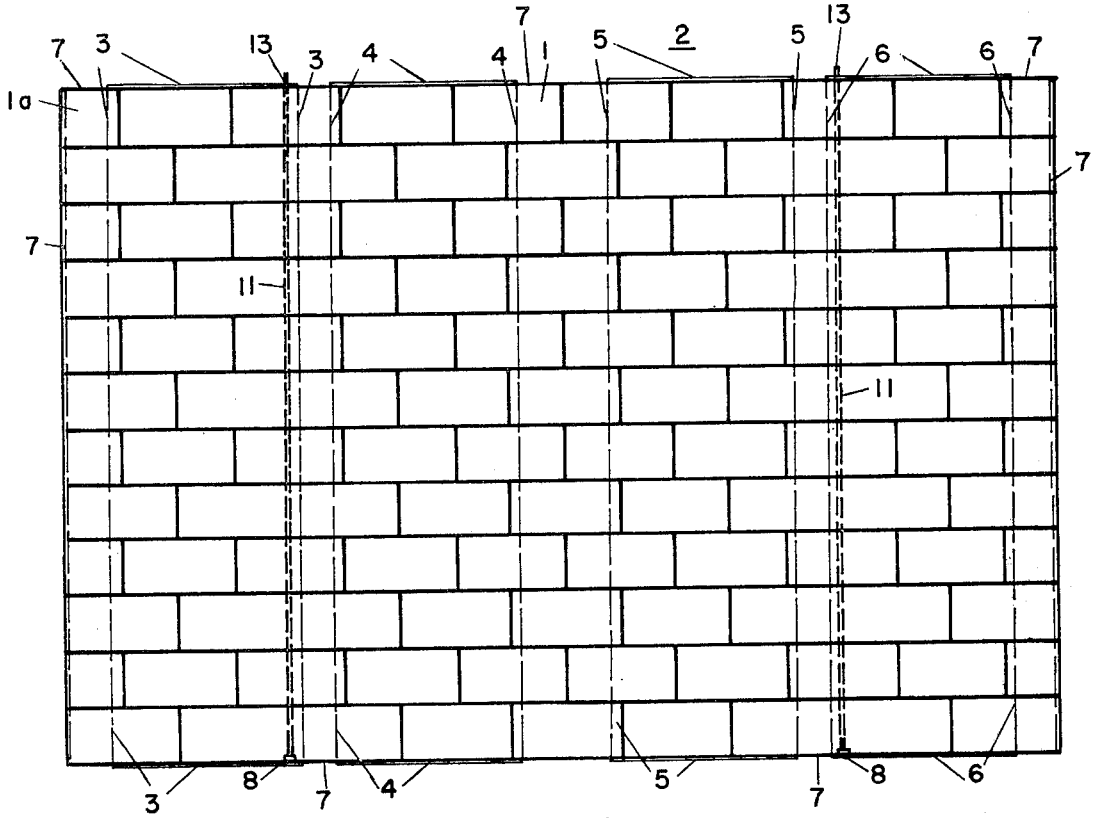
Figure 7:
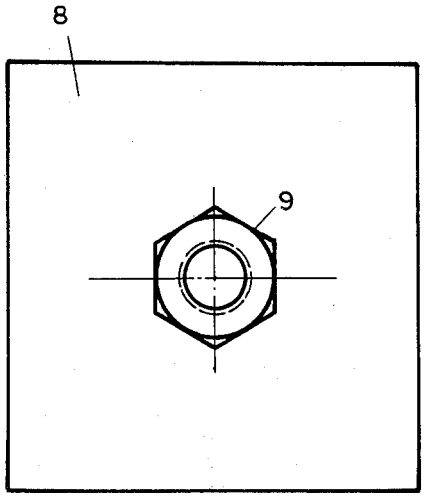
Figure 8:
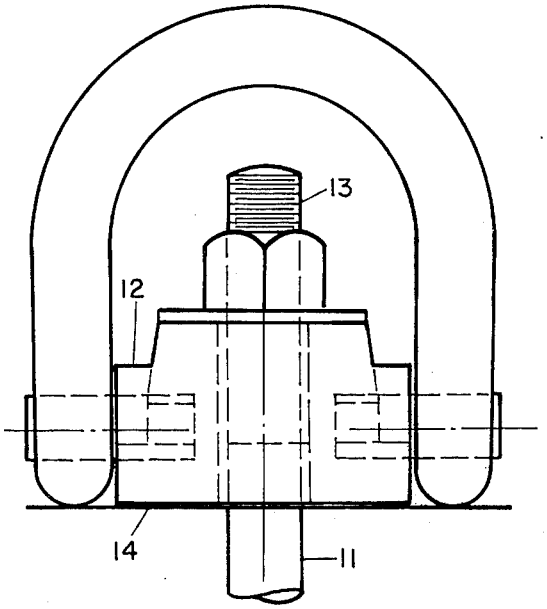
Figure 6:
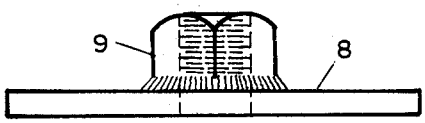
Figure 9:
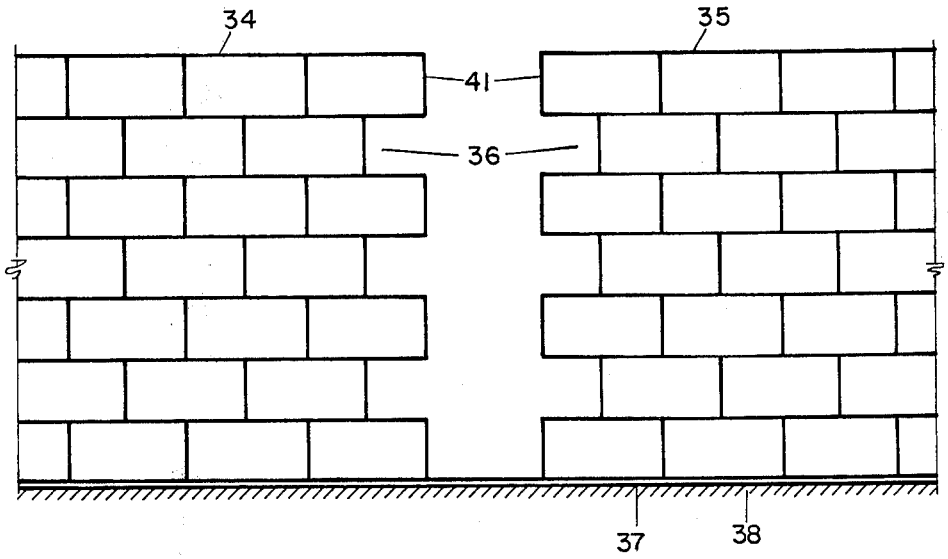

FIG. 5 is an elevation of the panel after the blocks are laid up and the lifting rods and steel strapping installed and before the outer surfaces of the panel are plastered with a glass fiber cement mixture, FIG. 6 is an enlarged section of a pick up base used for the lower ends of the panel pick up rods, FIG. 7 is a top view of the pick up base, FIG. 8 is an elevation of the lifting swivel attached to the upper end of the pick up rod and FIG. 9 is a fragmentary elevation showing panels for basement walls and the joint between adjacent panels.

FIG. 5 shows how the cement blocks 1 are laid up for an 8 × 12 feet panel 2. The blocks are stacked with no morar between the joints. The upper and lower surface of the blocks are ground flat as these are the load bearing surfaces. The stacking of the blocks may conveniently be done on a tilt table. When the stacking is completed top to bottom loops 3, 4, 5, 6 of steel strapping with sides horizontally spaced about two blocks apart pull the blocks inside the loops tight against each other. A peripheral loop 7 of steel strapping extends around the complete wall. Two lifting plates or bases 8 shown in enlarged scale in FIG. 6 and 7 are positioned so that nuts 9 are aligned with and extend into opening sin the blocks in the lowest course. A lifting rod 11 is screwed into each nut 9 and a swivel 12 is bolted on to the upper end 13 of the rod compressing the blocks between the plate 8 and the base 14 of the swivel 12. The blocks are all now tight together and may be picked up by a sling attached to the loops 14 of the swivel.

Figure 3:
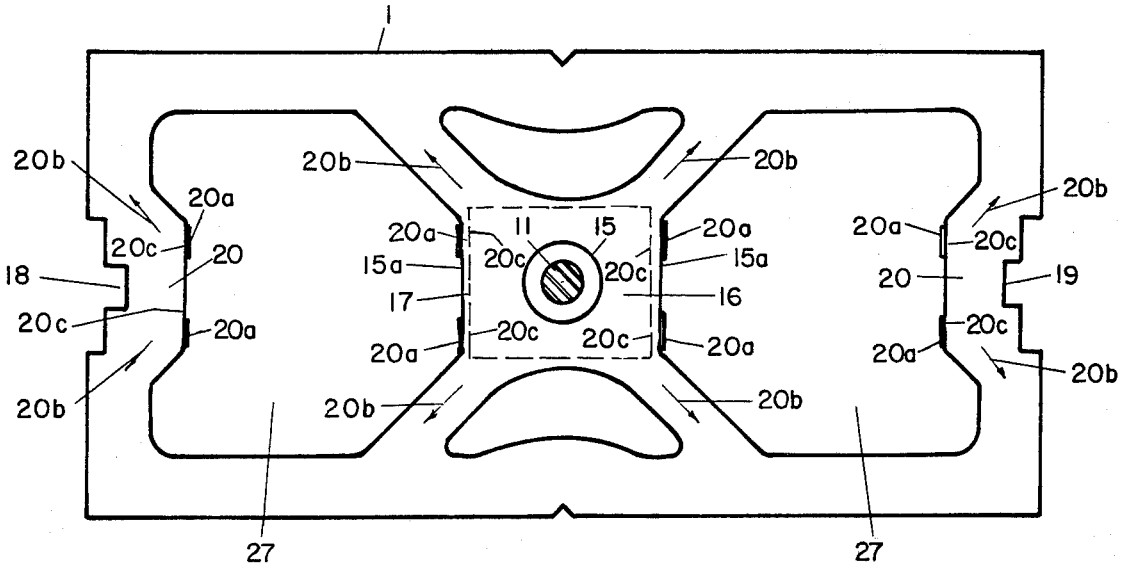
FIG. 3 is a top view of one of the concrete blocks used in the panel.
Figure 4:
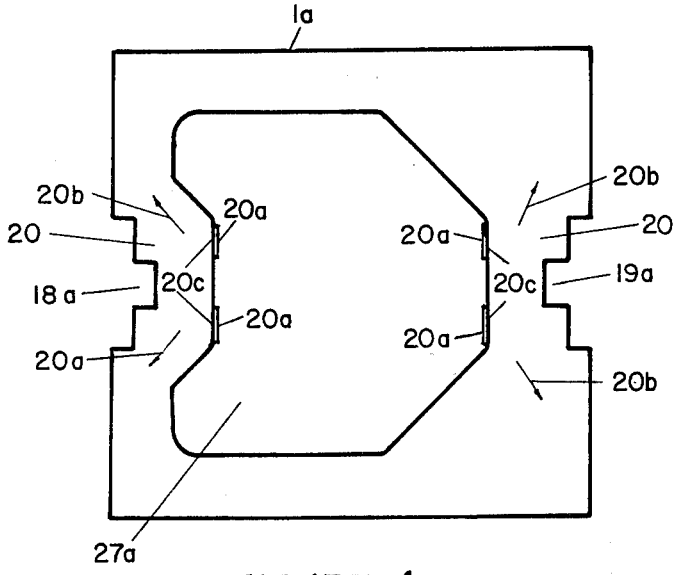
FIG. 4 is a top view of a half block for use with FIG. 3 block.

The full or long concrete block 1 and is companion half or short block 1*a* are specially designed to receive the lift rods 11 and the steel strapping for the loops 3–7 inclusive. The block 1 has a vertical piller 15*a* extending between the top and bottom surfaces of the block with center hole 15 large enough to loosely receive the nut 9 of the lifting plate 8. The hole 15 also provides a clearance opening for the lifting rod 11. Surrounding the center hole 15 is a surface 16 for receiving the lifting plate 8 which is shown in outline by dotted lines 17 in FIG. 3. Pillars equivalent to the piller 15*a* and center holes equivalent to the center hole 15 are provided by notches 18, 19 in opposite ends of the block 1 and notches 18*a*, 19*a* in opposite ends of the half block 1*a*. Surfaces 20 cooperate with each other when the blocks 1, 1*a* are stacked end to end to provide surfaces equivalent to the surface 16. This means that with the blocks staggered as shown in FIG. 5, each lifting rod extends through pillars 15*a* and equivalent pillars formed by the notches 18, 19, 18*a* and 19*a*. There is therefore a direct transmission of the gravity load through the pillars 15*a* and the surfaces 16, 20. At opposite ends of the surfaces 16 and at either edges of the surfaces 20 are thrust surfaces 20*c* for steel strapping 20*a*. Of course the steel strapping does not contact every surface 20*c* as shown, but every block is capable of receiving the steel strapping. The forces exerted by the steel strapping are indicated by arrows 20*b*. The steel strapping extends through the core holes 27, 27*a* of the blocks. The core holes and the surfaces 20*c* are always in alignment when the blocks are stacked in the usual staggered joint system.

After the steel strapping 3 – 7 and lifting rods 11 have been installed, the blocks are rigidly positioned and clamped together and the panel may be lifted by a sling attached to the swivel loops 14 and moved to another area where opposite side surfaces of the panel are plastered with a cement-fiber glass composition which seals the inner and outer surfaces of the panels and greatly increases the strength of the panel so it can withstand the tension stresses arising from either wind loads or flexural loads caused by eccentricity. After the plaster has set or cured, the panel is ready for trucking to the construction site.

Figure 1:
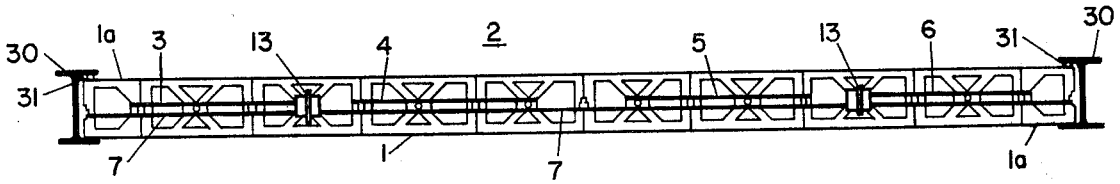
FIG. 1 is a top view of one of the panels assembled between steel I beams columns.
Figure 2:
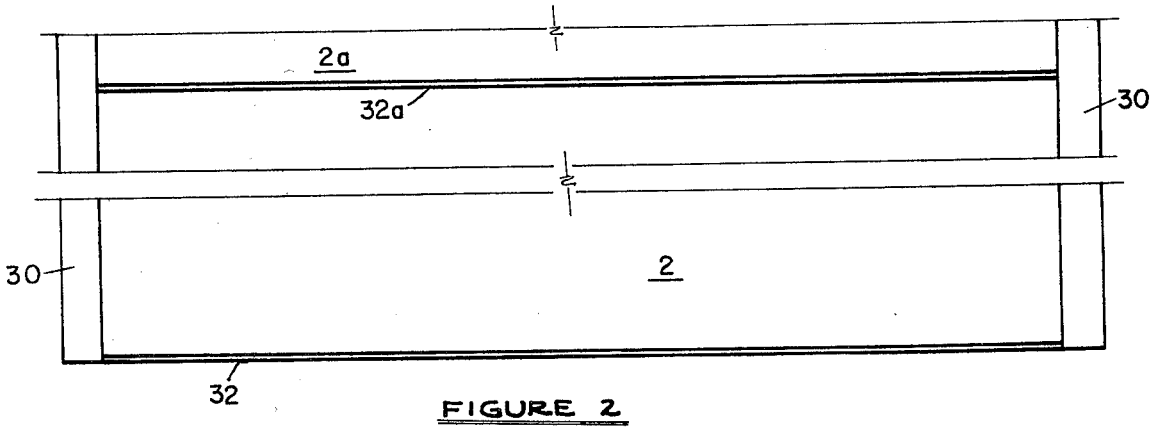
FIG. 2 is an elevation showing the joints between the panels but not the details of construction of the panels.

FIGS. 1 and 2 show the installation of the panels in a building such as a warehouse, shopping center, machine shop or other industrial or commercial building requiring walls up to 32 feet high.

First, steel I beam columns 30 are erected with channels 31 facing each other. Then panels 2 are successively dropped in place between two of the channels 31. The lower panel rests on a mortar bed 32 on the foundation 33. The next panel 2*a* rests on a mortar bed 32*a* on the top of the first panel 2. As each panel is dropped in place a mason provides the mortar bed 32, 32*a*, etc, and either grouts the panels to the I beams, or uses a continuous wood wedge to secure the panel between the flanges of the structural wide flange column. The panels are dropped in place by the same crane which positioned the steel columns so that at the end of the steel erection the entire building wall is completed.

The thickness of the lifting base 8 is the thickness of the mortar joints 32, 32*a*. The excess mortar squeezes out the joint as the base bottom. After each panel is errected the lifting rods are disconnected and the lifting bases remain permanently in the finished wall.

Another use of the panels as shown in FIG. 9 is for concrete block basement walls. The panels 34, 35 are made with staggered ends 36. Alternate courses are one block shorter. Each panel is set on a bed 37 of mortar on a foundation 38 with the projecting end faces abutting. When the panels are positioned so end faces 41 abut, the shorter courses cooperate to provide openings the size of one block. The installation is completed by inserting blocks which are ⅜ inches smaller in height and length than those used within the large panels in the openings and coating the blocks with the cement glass fiber mixture to complete the basement wall. A 24 × 30 foot basement might require eight panels which could be set in place in from 1 to 2 hours.

I claim:

1. A prefabricated concrete block wall panel, said panel being one block thick, a plurality of blocks high and a plurality of blocks long and comprising a plurality of contiguous courses of concrete blocks with the joints between the blocks and courses dry and with the joints between blocks in adjacent courses staggered, the blocks having vertically aligned load carrying pillars with vertically aligned openings for vertical lifting rods extending through the pillars from top to bottom, a plate at the lower end of each rod in thrust relation to the pillar surrounding its rod and connected to its rod by a releasable load carrying connection, the blocks having vertical core openings and thrust surfaces within said core openings vertically aligned from top to bottom, a plurality of tension loops at the center of the panel each surrounding a plurality of blocks both vertically and horizontally and each engaging said thrust surfaces for pulling the blocks within the loops tight against each other both vertically and horizontally and putting the blocks in compression both vertically and horizontally, one of the loops being a perimeter loop encircling the panel and the other loops being spaced from each other along the length of the panel and having sides of each loop spaced apart a plurality of blocks.

2. The panel of claim 1 in which the tension loops are steel strapping.

3. The panel of claim 1 in which the panel has coating of glass fiber cement on opposite surfaces of the panel for surface bonding the blocks.

4. The panel of claim 1 in which alternate courses are shorter than the other courses and are stacked to provide recesses in each end of the panel of thickness, height and length equal to one half block so that when two panels are arranged with the ends of the panels abutting the spaces between alternate courses are equal to one full block and the joints between the ends of said panels may be completed by inserting a single full block in each of said spaces.

5. A prefabricated concrete wall panel which may be prefabricated and delivered to a constructon site in modular sizes, said panel having planar top and bottom load bearing surfaces and laterally spaced top and bottom holes for lifting rods, a plate at the lower end of each rod in thrust relation to and extending below said bottom surface adjacent each rod and laterally spaced from the plate on another rod and connected to each rod by a releasable load carrying connection, the thickness of the plate being the thickness of a mortar joint so that when the panel is lowered onto a bed of mortar on a supporting surface with said bottom surface in load bearing relation to the mortar the excess mortar is squeezed out leaving only a mortar joint of thickness equal to the thickness of the plate.

6. A concrete block having planar top and bottom surfaces and a first vertical central piller between said surfaces with a vertical opening in the pillar for a lifting rod, a top to bottom core opening between opposite sides of said pillar and each end of the block, and end formations on said block shaped to cooperate with the end formation of another like block when two of said blocks are arranged end to end to provide a second pillar with an opening in alignment with the opening of the first pillar of another of said blocks centered on the joint between said two blocks.

7. The concrete block of claim 6 having vertical thrust surfaces parallel to each other at the center of the block and on said opposite sides of said first pillar for tension straps extending through said core openings for pulling said block horizontally toward an adjacent block.

8. The concrete block of claim 7 having struts diverging from opposite edges of the thrust surfaces of said first pillar toward opposite ends of the block for transmitting forces from said straps toward the side of the block.

9. The panel of claim 1 in which the panel has planar top and bottom load bearing surfaces, each plate being in thrust relation to and extending below said bottom surface adjacent its rod and laterally spaced from the plate on another rod, the thickness of the plate being the thickness of a mortar joint so that when the panel is lowered onto a bed of mortar on a supporting surface with said bottom surface in load bearing relation to the mortar the excess mortar is squeezed out leaving only a mortar join equal to the thickness of the plate.

10. The panel of claim 5 in which the releasable load carrying connection comprises screw threads on the rod made up with screw threads on the plate.

11. A prefaricated concrete block wall panel, said panel being one block thick, a plurality of blocks high and a plurality of blocks long and consisting essentially of a plurality of contiguous horizontal courses of concrete blocks with the joints between blocks and courses dry and with the blocks in adjacent courses staggered, the individual blocks having vertically aligned load carrying pillars with vertically aligned openings for lifting rods extending through the pillars from top to bottom, a plate at the lower end of each rod in thrust relation to the lower end of the pillar surrounding its rod by a releasable load carrying connection, the blocks having vertical core openings and vertical thrust surfaces within said core openings vertically aligned from top to bottom, a plurality of tension loops at the center of and in the plane of the panel engaging said thrust surfaces for pullng the blocks within the loops tight against each other and putting the blocks in compression both vertically and horizontally, one of said loops being a perimeter loop encircling the panel and the other loops being spaced from each other along the length of the panel and having sides of each loop spaced apart a plurality of blocks.

12. The panel of claim 11 in which the panel has coating of glass fiber cement on opposite surfaces of the panel for surface bonding the blocks.

13. The panel of claim 11 in which one of said loops spaced along the panel has a side extending through blocks within the sides of another of said loops adjoining said one loop.

* * * * *